US011175034B2

(12) United States Patent
Tompkins et al.

(10) Patent No.: US 11,175,034 B2
(45) **Date of Patent: *Nov. 16, 2021**

(54) BURNER AND AIR SUPPLY ASSEMBLY FOR HORIZONTAL IMMERSION TUBE BOILERS

(71) Applicant: Sellers Manufacturing Co., Danville, KY (US)

(72) Inventors: Gene Allen Tompkins, Oshkosh, WI (US); James A. Board, Jr., Stanford, KY (US)

(73) Assignee: Sellers Manufacturing Co., Danville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/800,774

(22) Filed: Feb. 25, 2020

(65) Prior Publication Data

US 2020/0284430 A1 Sep. 10, 2020

Related U.S. Application Data

(63) Continuation of application No. 15/610,215, filed on May 31, 2017, now Pat. No. 10,619,848.
(Continued)

(51) Int. Cl.

| | |
|---|---|
| ***F23D 14/48*** | (2006.01) |
| ***F23C 3/00*** | (2006.01) |
| ***F23D 11/40*** | (2006.01) |
| ***F23D 23/00*** | (2006.01) |
| ***F23D 14/70*** | (2006.01) |

(Continued)

(52) U.S. Cl.
CPC ..... *F23D 14/48* (2013.01); *F23C 3/002* (2013.01); *F23C 3/004* (2013.01); *F23D 11/406* (2013.01); *F23D 14/02* (2013.01); *F23D 14/70* (2013.01); *F23D 14/82* (2013.01); *F23D 23/00* (2013.01); *F23D 2209/10* (2013.01); *F23D 2209/20* (2013.01)

(58) Field of Classification Search
CPC ..... F23D 14/08; F23D 14/82; F23D 14/48; F23D 2209/10; F23C 3/002; F23C 3/004
USPC ..... 431/8, 159
See application file for complete search history.

(56) References Cited

U.S. PATENT DOCUMENTS

| | | |
|---|---|---|
| 2,126,417 A | 8/1938 | Sharp |
| 3,438,719 A | 4/1969 | Gething |

(Continued)

*Primary Examiner* — Vivek K Shirsat
(74) *Attorney, Agent, or Firm* — Greenberg Traurig, LLP

(57) ABSTRACT

Horizontal immersion tube boilers include a plurality of burner nozzles positioned in substantial alignment with a respective plurality of boiler tubes. Fuel-air mixture directed through the burner nozzles are ignited by a pilot flame system positioned proximate to the burner nozzles within a combustion chamber. The burner nozzles and pilot flame system receive air from a secondary air manifold having inlets that provide secondary air into the combustion chamber. The flames extending from the burner nozzles are directed into the respective boiler tubes, which exchange heat from the flame into water within a boiler shell. The secondary air inlets direct air around the burner nozzles and toward the boiler tubes, creating an air blanket around each burner nozzle for reducing turbulence and guide the flames into their respective boiler tubes. An improved flame arrestor within the nozzle prevents flame back-flow when modulating to lower firing rates.

9 Claims, 11 Drawing Sheets

Related U.S. Application Data

(60) Provisional application No. 62/343,544, filed on May 31, 2016.

(51) Int. Cl.
*F23D 14/02* (2006.01)
*F23D 14/82* (2006.01)

(56) References Cited

U.S. PATENT DOCUMENTS

| | | | | |
|---|---|---|---|---|
| 3,849,058 | A * | 11/1974 | Pankow | F23D 14/08 431/264 |
| 4,184,837 | A | 1/1980 | Manning | |
| 10,619,848 | B2 * | 4/2020 | Tompkins | F23D 14/48 |
| 2006/0008755 | A1 | 1/2006 | Leinemann et al. | |

* cited by examiner

BURNER AND AIR SUPPLY ASSEMBLY FOR HORIZONTAL IMMERSION TUBE BOILERS

CROSS REFERENCE TO RELATED APPLICATION

This application is a continuation of U.S. patent application Ser. No. 15/610,215, filed May 31, 2017, which is a non-provisional application claiming priority from U.S. Provisional Application No. 62/343,544 filed May 31, 2016, entitled "IMPROVED BURNER AND AIR SUPPLY ASSEMBLY FOR HORIZONTAL IMMERSION TUBE BOILERS," which are incorporated herein by reference in their entireties.

FIELD OF THE DISCLOSURE

The present disclosure generally relates to horizontal immersion tube boilers and components thereof. More specifically, the present disclosure relates to improvements to the burner nozzle and secondary air supply assemblies in horizontal immersion tube boilers that generate or provide steam or hot water for heating or process applications.

BACKGROUND OF RELATED ART

Combustion devices—such as furnaces and boilers—typically generate heat by burning a fuel-air mixture. To maintain the combustion reaction, a requisite amount of fuel and air must be supplied to a chamber, where it is ignited to produce heat. The amount of fuel that is burned in this reaction is dependent on a variety of factors, including the ignition and the flow rate of fuel and air, among other factors. Because combustion reactions involve a proper balance of input fuel, air, and ignition, sustaining these reactions can be a difficult task. Furthermore, the efficiency of a combustion reaction can be diminished if the ratio of fuel and air are not optimal for a given system and/or application.

Additionally, certain conditions within a combustion system can cause significant failures that are potentially dangerous or damaging to the device. For example, if the flow rate of fuel-air mixture into a chamber is too slow, an ignited fuel-air flame can travel "back" or upstream toward the fuel-air source. One way to address this problem involves placing a flame arrestor between the fuel-air source and the place of combustion to prevent any flame from traveling "upstream." While effective at improving the safety of a combustion device, flame arrestors often emit turbulent and stirred up fuel-air mixtures that results in an unstable flame. It is accordingly an objective of the present disclosure to provide a combustion device with an improved burner nozzle that incorporates a flame arrestor and that produces a stable flame.

Some combustion devices, such as boilers, involve heating water or another medium to a desired temperature. An example operation for a boiler involves initially heating water to a boiling point, and then maintaining the temperature of the water at or near that boiling point. Because the initial heating stage requires a greater amount of energy than maintaining already-heated water, a burner that operates in a single modality can be inefficient. If combustion is very hot, water can be heated quickly, but maintaining the water at a boiling temperature is inefficient. Conversely, if combustion is mild, water is initially heated very slowly, while maintaining the water at a desired temperature is more efficient. It is accordingly another objective of the present disclosure to provide a combustion device that can modulate across varying levels of combustion.

SUMMARY

Horizontal immersion tube boilers described herein include a plurality of burner nozzles positioned in substantial alignment with a respective plurality of boiler tubes. Fuel-air mixture directed through the burner nozzles are ignited by a pilot flame system positioned proximate to the burner nozzles within a combustion chamber. The burner nozzles and pilot flame system receive air from a secondary air manifold having inlets that provide secondary air into the combustion chamber. The flames extending from the burner nozzles are directed into the respective boiler tubes, which exchange heat from the flame into water within a boiler shell. The secondary air inlets direct air around the burner nozzles and toward the boiler tubes, creating an air blanket around each burner nozzle serving to reduce turbulence and guide the flames into their respective boiler tubes.

An improved burner nozzle includes a primary central chamber and one or more secondary chambers that at least partially surround the primary central chamber. Fuel-air mixture directed through the primary chamber flows at a higher rate compared to fuel-air mixture directed through the one or more surrounding secondary chambers, which produces a stable flame. A flame arrestor is incorporated into the burner nozzle which serves to regulate the flow rate of fuel-air mixture passing through the burner nozzle, and also to extinguish flames that may extend upstream from the combustion chamber back into the burner nozzle.

According to a first aspect of the present invention, there is provided a horizontal immersion tube boiler incorporating an improved burner and air supply assembly. The horizontal immersion tube boiler includes a boiler vessel with a first side and a second side, with a plurality of boiler tubes extending from the first side to the second side thereof. The horizontal immersion tube boiler also includes a combustion chamber disposed adjacent the first side of the boiler vessel and an exhaust stack disposed the second side of the boiler vessel. The boiler tubes connect the combustion chamber section to the exhaust stack. The horizontal immersion tube boiler further comprises a burner assembly disposed within the combustion chamber. The burner assembly includes a plurality of burner nozzles corresponding to the plurality of boiler tubes. Each burner nozzle is positioned adjacent to and not extending into its respective boiler tube, and further incorporates a flame arrestor. Each flame arrestor has a first plurality of passages of a first diameter and a second plurality of passages of a second diameter. The first plurality of passages is positioned within a substantially circular region proximate to a radial center of the flame arrestor, while the second plurality of passages is circumferentially spaced around the substantially circular region. Additionally, the horizontal immersion tube boiler includes a secondary air supply at least partially disposed within the combustion chamber. The secondary air supply includes a plurality of orifices positioned at locations between the plurality of burner nozzles to direct air around the burner nozzles and guide flames extending from the burner nozzles into the respective boiler tubes.

According to a second aspect of the present invention, there is provided a burner nozzle for a horizontal immersion tube boiler that is operable to supply a flame into a boiler tube. The burner nozzle includes an inlet chamber operable to receive fuel-air mixture. The burner nozzle also includes a primary flow passage in coaxial alignment with the inlet chamber. The primary flow passage is operable to receive a first portion of the fuel-air mixture from the inlet chamber. The burner nozzle further includes a secondary flow passage that at least partially surrounds the primary flow passage. The secondary flow passage is operable to receive a second portion of the fuel-air mixture from the inlet chamber. Additionally, the burner nozzle includes a plurality of outlet openings configured to direct the second portion of the fuel-air mixture from the secondary flow passage toward the boiler tube. Further, the burner nozzle includes a flame arrestor disposed proximate to the primary flow passage and configured to direct the first portion of the fuel-air mixture from the primary flow passage toward the boiler tube. The flame arrestor has a first plurality of passages of a first diameter and a second plurality of passages of a second diameter. The first plurality of passages is positioned within a substantially circular region proximate to a radial center of the flame arrestor, while the second plurality of passages is circumferentially spaced around the substantially circular region.

The foregoing summary is illustrative only and is not intended to be in any way limiting. In addition to the illustrative aspects, embodiments, and features described above, further aspects embodiments, and features will become apparent by reference to the figures and the following detailed description and the accompanying drawings.

DETAILED DESCRIPTION

Figure 1:
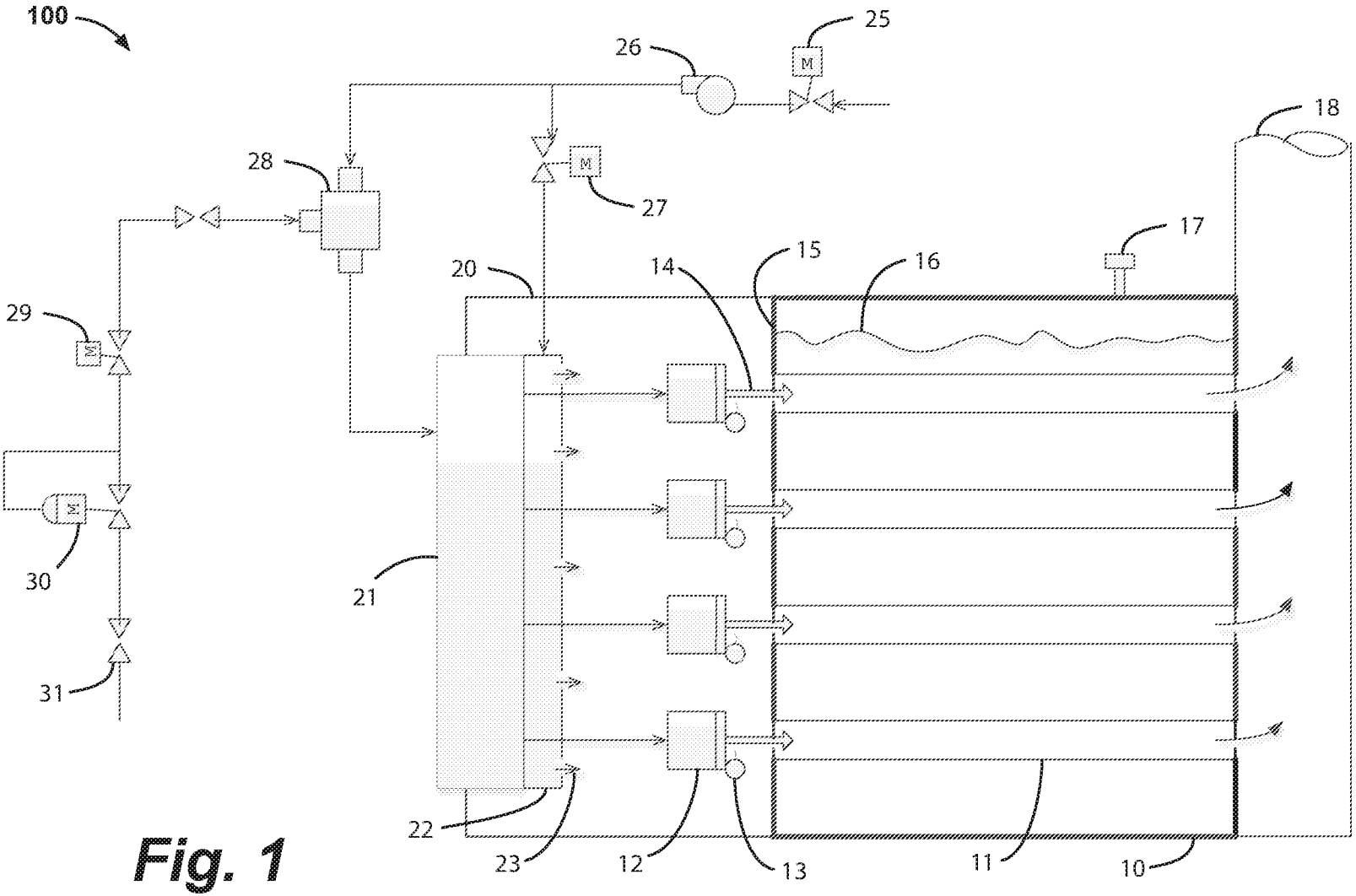
FIG. 1 is a schematic diagram of a horizontal immersion tube boiler, according to an example embodiment.

The following description of example methods and apparatus is not intended to limit the scope of the description to the precise form or forms detailed herein. Instead the following description is intended to be illustrative so that others may follow its teachings.

I. INTRODUCTION

Boilers of the present application described herein incorporate the concept of an immersion tube burner in the environment of a horizontal Firetube boiler. Traditional immersion burners incorporate a firing head that is physically inserted into a small burner tube. The tube is placed in a vessel that contains a liquid such that the tube heats the liquid. Because traditional immersion burners fire into a smaller tube, they are typically limited in size and energy flow.

A traditional Scotch Marine firetube boiler (referred to herein as a "traditional Firetube boiler") is a shell and tube style heat exchanger that is intended for much higher energy ratings than immersion burners and can provide very efficient heat transfer. The traditional Firetube boiler has a large furnace to provide space for combustion, and multiple passes with small diameter tubes that provide convective heat transfer downstream of the furnace. Applying the immersion burner concept to the traditional Firetube boiler eliminates the furnace, turnaround sections, refractory and thermal shock.

Horizontal immersion tube boilers include a vessel incorporating a tube heat exchanger where the heat generated by burning fuel inside the tubes is transferred to the water contained in the vessel to, in turn, create steam or hot water. A burner assembly is provided to burn a fuel/air mixture within a furnace chamber at the face of the vessel. The boiler tubes used to provide convective heat transfer are typically 2" or 2.5" in diameter. Convective heat transfer requires large surface area and turbulent flow for effective heat transfer. Boiler tubes offer the ability to provide both turbulent flow (higher velocities in small tube diameters) and larger surface area for heat transfer compared to other boiler types, such as watertube or cast iron boilers. Variations in the number of passes, tube diameters and number of tubes allows the boiler design to be optimized for the application. Horizontal immersion tube boilers typically include an integral burner together with burner control system, fuel trains and water controls, and other components and utilities required to make the boiler unit operational. Installation typically includes stacks and breechings, fuel, electrical and water supplies, steam or hot water lines, all typically installed in a boiler or mechanical room.

The horizontal immersion tube boiler disclosed herein is a single pass design where individual burners are fired into each of the boiler tubes that pass one time through the boiler vessel. The exhaust gases pass out the end of each tube and exit through a stack. This vessel is thus deemed a single pass boiler and no turnaround chambers are required eliminating the need for related refractory or additional pressure vessel components. A typical single pass Firetube boiler eliminates many of the problems of a traditional multi-pass Firetube boiler, in particular, thermal shock.

Thermal shock is the condition where, during startup, the furnace receives heat more quickly than the boiler tubes, and thus expands more quickly than the boiler tubes. These disparate rates of expansion can force some of the boiler tubes, which are adjacent to the furnace, to be pulled loose causing leaks. In other cases, the stress caused by this difference in the rates of expansion can result in fatigue cracks in the tube attachments, especially where the tubes are welded into the tube sheet. Thermal shock can be controlled by using a slow process to warm up the boiler, which keeps the expansion more uniform. However, longer times to produce steam or hot water are not always acceptable. Thermal shock also results from the use of multiple furnace and tubes passing within a single vessel where each pass can have a different rate of expansion and contraction which will cause high mechanical stresses that can, in turn, damage the tube attachments, causing leaks and metal failure. The elimination of the large traditional furnace and turnaround chamber allows the vessel to be much smaller than a traditional Firetube boiler and provides a quick warm-up time to steaming.

The burner used in such prior art immersion tube boilers is of a pre-mix design (fuel and air are mixed in advance of the ignition point) that operates only at its rated capacity. In order to fire into individual tubes, the burner includes multiple small nozzles each aimed into a single boiler tube. A pilot is used to ignite a flame at each of the plurality of nozzles. This "non-modulating" design operates in a single on-off mode where when "on" the boiler operates at its rated capacity and thus cannot operate in a modulated manner, e.g., at one or more reduced capacities between off and 100%.

Prior art horizontal Firetube boilers are unable to modulate because their nozzle designs can only function within a limited range of pre-mix fuel/air velocities. At the upper end, if the fuel/air velocity is too high, the flame is pushed off the nozzle because the flame speed is lower than the fuel/air mixture velocity. At lower velocities, the flame retracts into the nozzle and, in turn, into the gas manifold, likely causing an explosion. Because of these limitations, the typical immersion Firetube boiler was limited to operating only with an "On-Off" burner.

There has been a growing understanding that reducing the number of times a boiler transitions from an off to on mode, otherwise referred to as boiler "On-Off" cycling, improves the overall boiler efficiency. The reason is that every time the boiler starts it must first purge the furnace to remove any potential explosive gases that may still exist. The purge cycle pushes large quantities of air through the furnace and in turn the vessel, to force out any residual unburned fuel/air mixture, but in doing so, the purge air is heated by the surrounding boiler water, and exits the stack carrying with it the thermal energy removed from the boiler water such that additional fuel/air must be burned to return the boiler to operating temperature. If the boiler cycles on and off frequently, the decrease in the efficiency can become very large.

Efforts have been made to design acceptable modulation functionality into a horizontal immersion Firetube boiler line for many years, and until the present invention, without success.

The improved Firetube boiler disclosed herein achieves the desired modulation through the use of improved burner and air supply assemblies.

II. HORIZONTAL IMMERSION TUBE BOILER SYSTEM

FIG. 1 is a schematic diagram of a horizontal immersion tube boiler incorporating the improved burner and air supply assemblies according the present invention. The boiler is shown comprising boiler shell 10 and the adjacent combustion chamber section 20. Boiler shell 10 comprises a vessel filled with water, filled to water level 16. A plurality of boiler tubes 11 pass through boiler shell 10 with each tube surrounded by water.

Combustion chamber 20 includes a manifold assembly 21 which is supplied with a fuel and air mixture emanating from fuel/air mixing valve 28. The fuel/air mixture is fed from manifold 21 to a plurality of nozzle assemblies 12. Each nozzle includes a flame arrester element. Nozzle assemblies 12 are positioned offset from the opening of each boiler tube, as opposed to inserted into the boiler tube opening as in some prior art configurations. A running pilot 13 is shown positioned adjacent the front of each nozzle assembly 12 which serves to ignite the fuel air mixture to produce flame 14.

The horizontal immersion tube boiler depicted is a single pass system where the exhaust from the combusted fuel air mixture passes only once through the boiler shell, exits at the rear and is vented through stack outlet 18 to the atmosphere. Steam outlet 17 conducts the generated steam/hot water from the boiler assembly to the requisite heating systems or process equipment.

Figure 12:
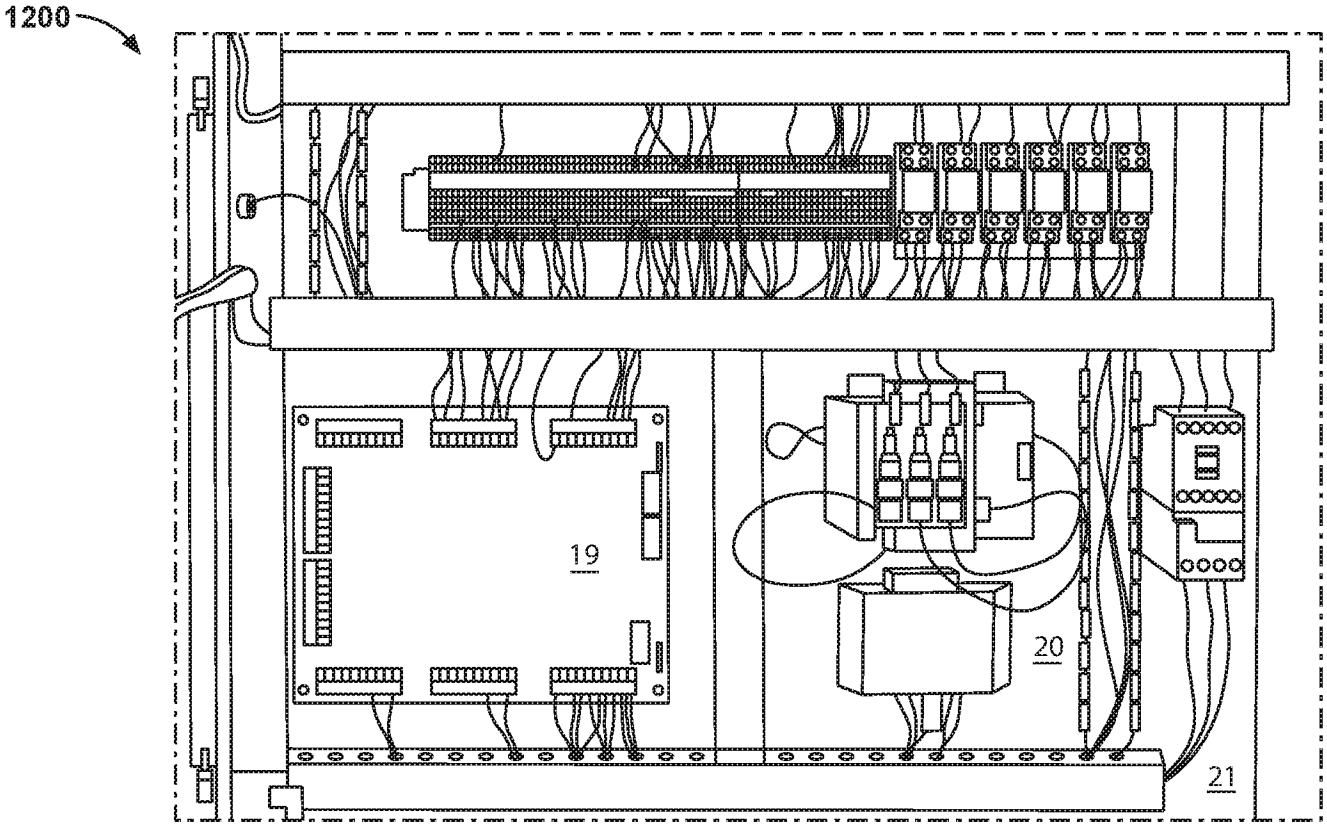
FIG. 12 depicts a front view of a control panel for a horizontal immersion tube boiler, according to an example embodiment.

Servomotor controlled air damper 25 modulates the source of air that is available to air fan 26 which, in turn, is provided to air mixing valve 28 and secondary air valve 27, as described below. Fuel/air mixer 28 mixes incoming air with the fuel to be burned in the boiler assembly. Shut-off valve 31 connects the system to an external source of fuel, such as natural gas or another combustible gas. Safety shut-off 30 together with gas flow control 29 control the incoming flow of fuel gas. Gas flow control 29 and air damper 25 are controlled by electronic control systems, which is shown in FIG. 12.

The present system incorporates a novel secondary air chamber 22. Secondary air chamber 22 is fed with a source of air from secondary air valve 27. The air fed to secondary air chamber 22, positioned within combustion chamber 20, exits via secondary outlets 23 and serves to further control the flames emanating from nozzle assemblies 12 in a desirable manner as described herein.

III. BURNER NOZZLE AND FLAME ARRESTOR ASSEMBLY

Figure 2A:
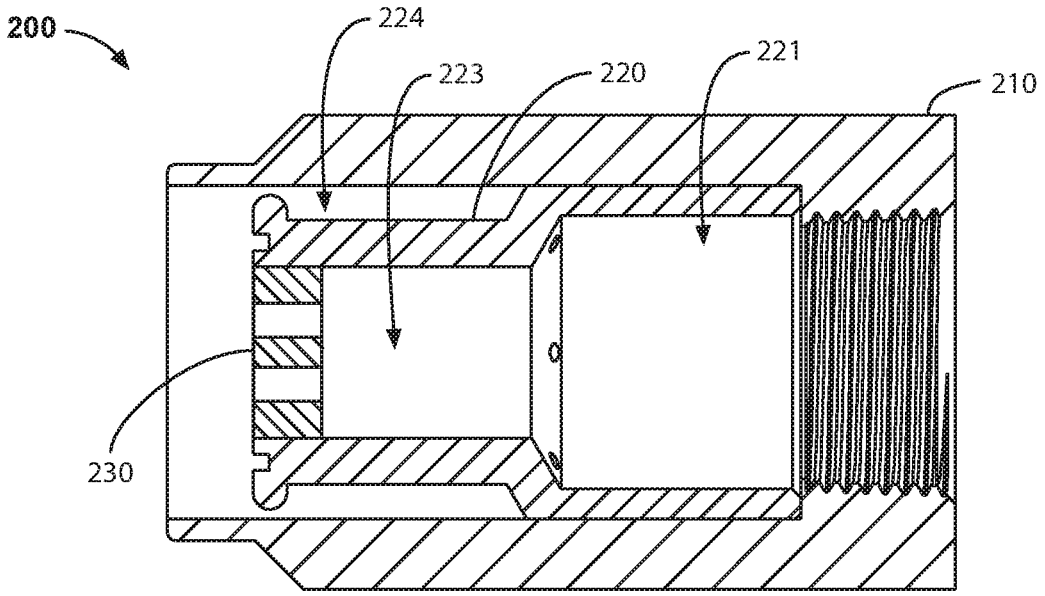
FIG. 2A is a cross-sectional elevation view of a burner nozzle with an integrated flame arrestor, taken along lines A-A of FIG. 2B, according to an example embodiment.
Figure 2B:
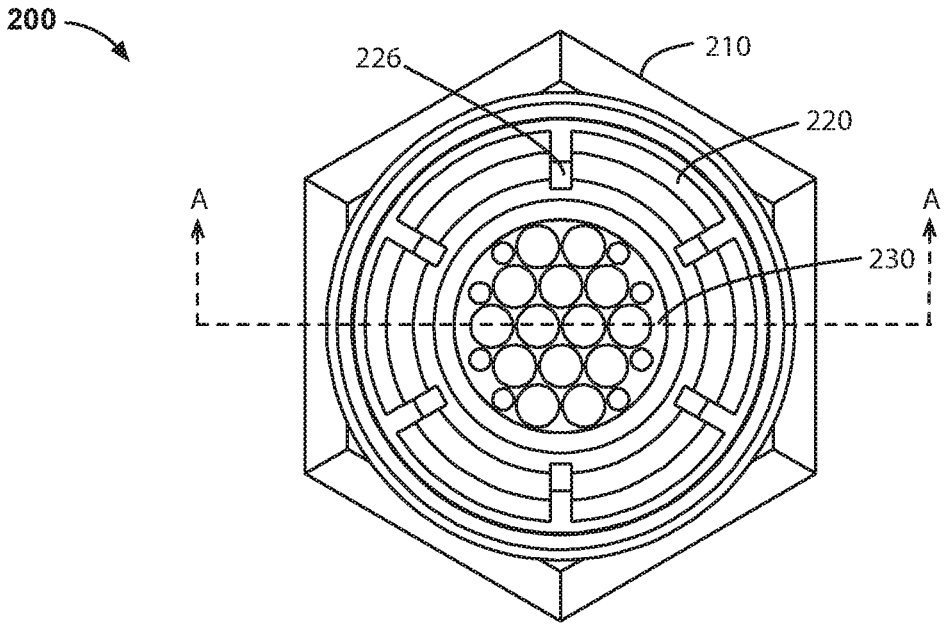
FIG. 2B is a front elevation view of the burner nozzle with an integrated flame arrestor shown in FIG. 2A.
Figure 3C:
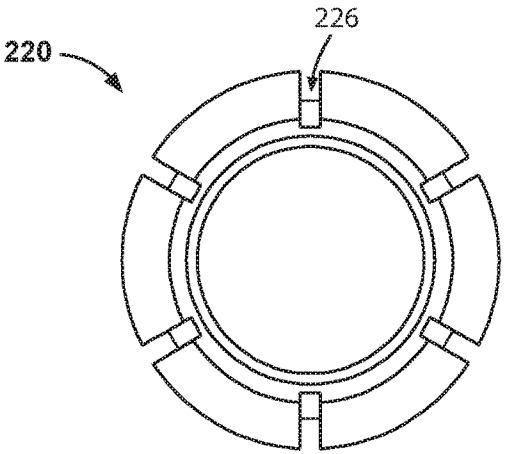
FIG. 3C is a front elevation view the burner nozzle spool shown in FIG. 3A.
Figure 3D:
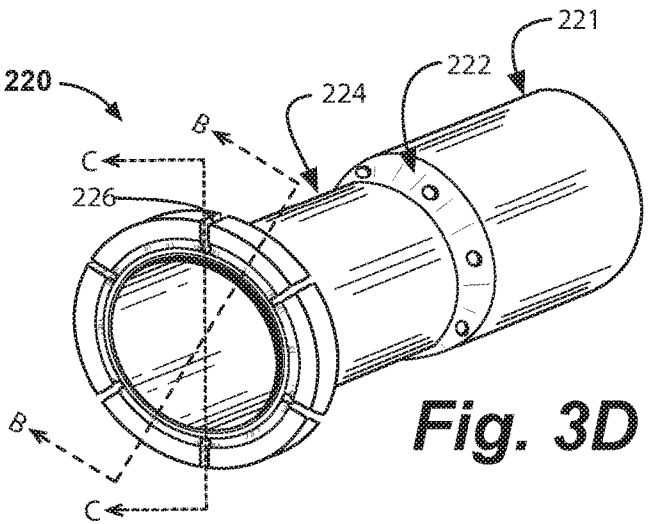
FIG. 3D is a front perspective view of the burner nozzle spool shown in FIG. 3A.
Figure 3A:
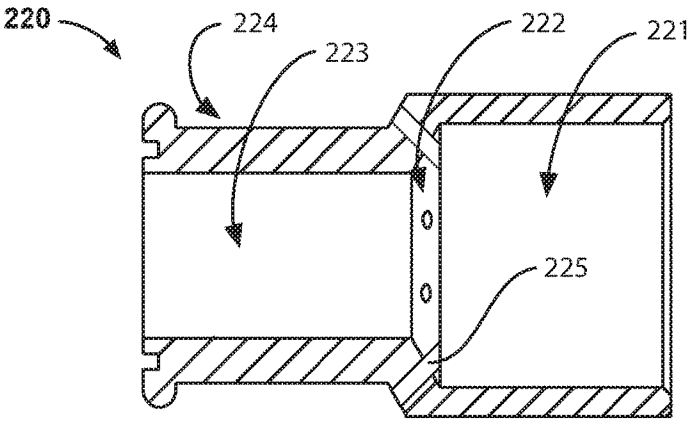
FIG. 3A is a cross-sectional elevation view of a burner nozzle spool with a flame retention ring, taken along lines B-B of FIG. 3D, according to an example embodiment.
Figure 3B:
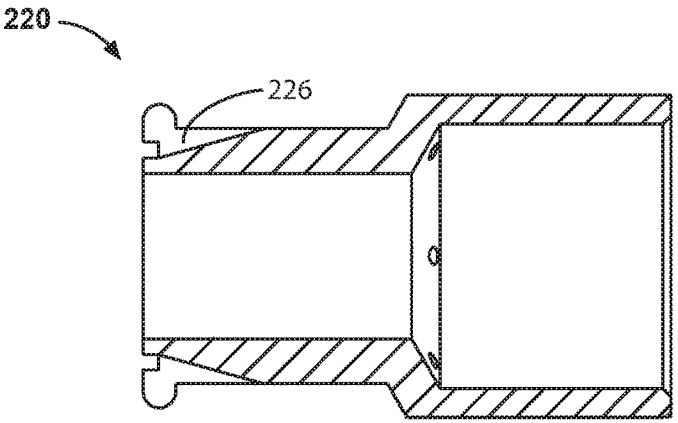
FIG. 3B is a cross-sectional elevation view of the burner nozzle spool with a flame retention ring, taken along lines C-C of FIG. 3D, as shown in FIG. 3A.

FIGS. 2A and 2B illustrate views of an example burner nozzle assembly 200 with an integrated flame arrestor. Burner nozzle assembly 200 includes burner nozzle housing 210, burner nozzle spool 220, and flame arrestor 230. In some implementations, flame arrestor 230 is substantially circular and is friction fit into the central bore of spool 220. The combined flame arrestor 230 and spool 220 can then be friction fit (or otherwise secured into) the inner cavity of housing 210.

Spool 220, which is shown in greater detail in FIGS. 3A-3D, may be substantially cylindrical in shape and include inlet chamber 221, primary flow passage 223, and secondary flow passage 224. In operation, inlet chamber 221 receives fuel-air mixture from a fuel-air mixture source (e.g., a fuel-air mixing valve). This fuel-air mixture is distributed into two different passages: primary flow passage 223 and secondary flow passage 224. The central bore through spool 220 extends from inlet chamber 221 and slightly narrows into primary flow passage 223. Orifices 225 circumferentially spaced around transition region 222 fluidly connect inlet chamber 221 with secondary flow passage 224, which surrounds primary flow chamber 223. Fuel-air mixture in primary flow passage 223 is directed through holes in flame arrestor 230, while fuel-air mixture in secondary flow passage 224 is directed through outlet openings 226.

Because the size of the central bore is substantially greater than the collective size of orifices 225, fuel-air mixture passing through primary flow passage 223 flows at a higher velocity than fuel-air mixture passing through secondary flow passage 224 and out through outlet openings 226. This difference in fuel-air mixture flow rate—where fuel-air mixture near the radial center of burner nozzle assembly 200 flows at a greater velocity than fuel-air mixture near the outer circumference of burner nozzle assembly 200—serves to stabilize a flame extending from burner nozzle assembly 200.

Although spool 220 is illustrated having at least 6 outlet openings 226 and at least 4 orifices 225, other numbers of outlet openings and/or orifices may be included in spool 220 without departing from the scope of the present application. Note that, in the implementation shown in FIGS. 3A-3D, orifices 225 do not longitudinally align with the outlet openings 226. A given combustion system or boiler may have implementation-specific requirements for its burner nozzle that would result in including fewer or greater outlet openings and/or orifices. One of ordinary skill would appreciate the design considerations behind the particular size, shape, geometry, and arrangement of orifices, openings, and holes within spool 220 based on the present disclosure.

Figure 4A:
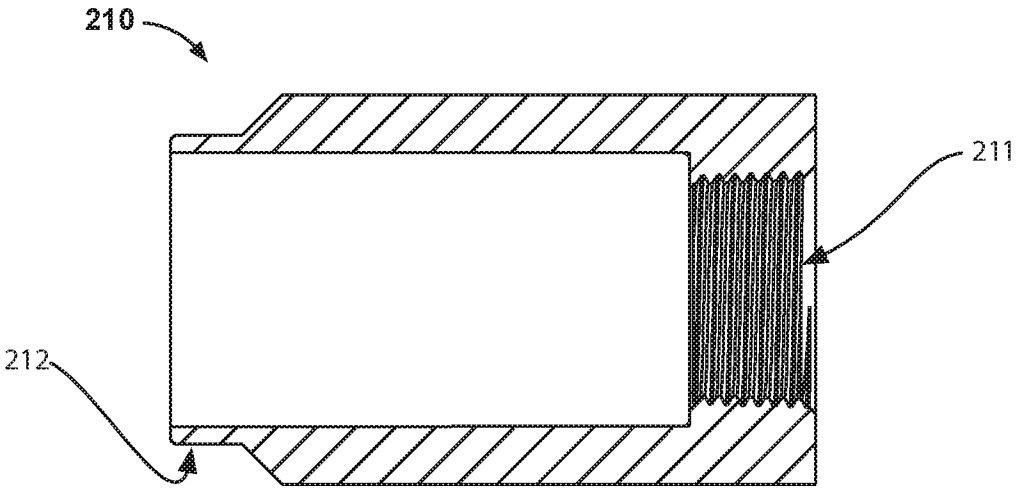
FIG. 4A is a cross-sectional elevation view of a burner nozzle housing, according to an example embodiment.
Figure 4B:
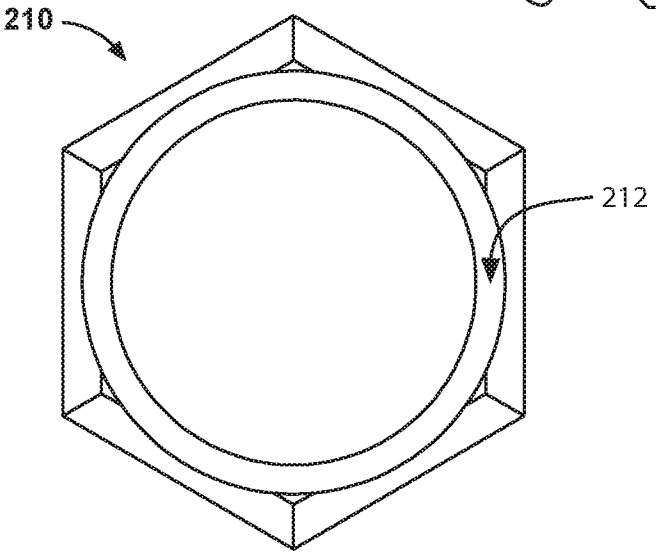
FIG. 4B is a front elevation view of the burner nozzle housing shown in FIG. 4A.

FIGS. 4A and 4B depict views of housing 210 of burner nozzle assembly 200. Housing 210 may include screw threading 211 for securing burner nozzle assembly 200 to a shaft or tube having a corresponding screw threading thereon. Housing 210 may be substantially cylindrical, or include a number of flat sides (e.g., hexagonal, octagonal, etc.) to allow housing 210 to be tightly fastened onto a screw threading using a wrench or similar tool. Additionally, annular lip 212 may extend outwardly, so as to surround spool 220 and flame arrestor 230. This annular lip 212 further serves to stabilize a flame extending from burner nozzle assembly 200.

Figure 5:
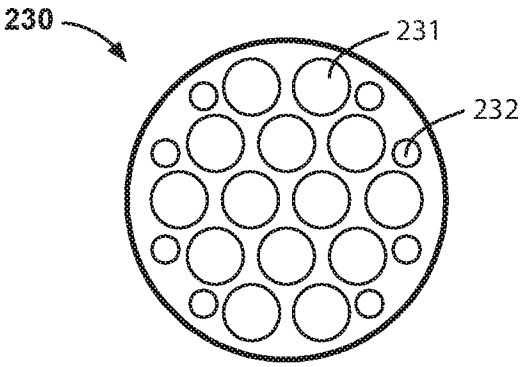
FIG. 5 is a front elevation view of a flame arrestor, according to an example embodiment.

An example flame arrestor 230 is shown in FIG. 5. Flame arrestor 230 includes a first plurality of passages 231 having a first diameter, and a second plurality of passages 232 having a second diameter. As will be appreciated by one of ordinary skill in the art, a given flame arrestor may incorporate some number of holes or passages therethrough that can serve to extinguish a flame flowing upstream back into its burner nozzle.

In a modulating horizontal immersion tube boiler, such as those described herein, the passages of the flame arrestor may collectively define a total flow area through which fuel-air mixture can pass. For example, the total flow area of flame arrestor 230 would be the sum of the areas of first plurality of passages 231 and second plurality of passages 232. Based on a pressure drop-flow rate relationship known to nozzle designers within the art, it is possible to determine the flow rate of fuel-air mixture passing through a given flame arrestor. Thus, a variety of flame arrestor implementations—which may include various passage diameters in other combinations and arrangements—may be used without departing from the scope of the present application.

IV. COMBUSTION CHAMBER WITH PILOT FLAME ASSEMBLY

Figure 6:
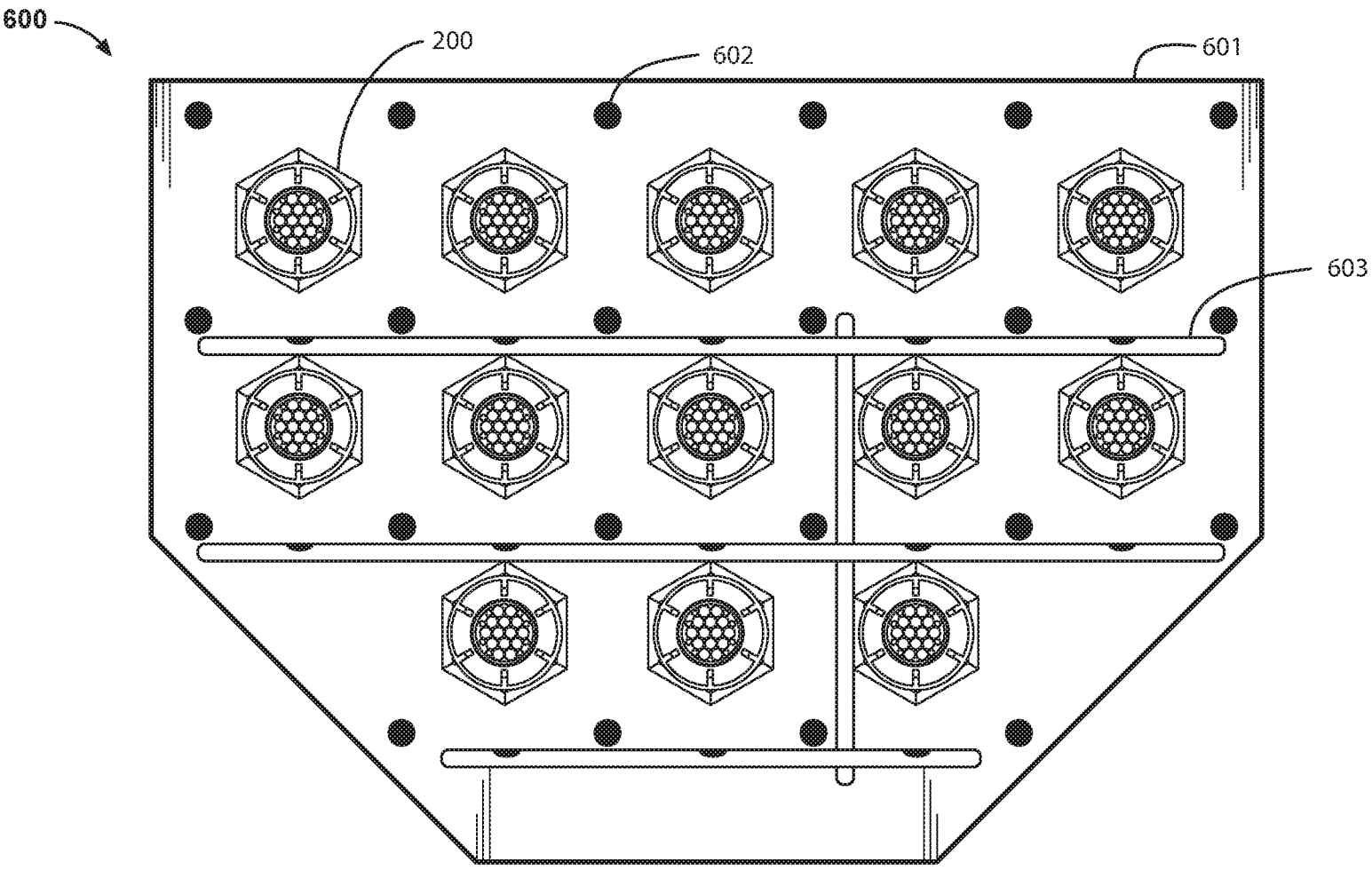
FIG. 6 is a front elevation view of a combustion chamber containing a plurality of burner nozzles, a secondary air manifold, and a pilot flame assembly, according to an example embodiment.

Unlike prior art boilers, horizontal immersion tube boilers described herein include a combustion chamber that contains a plurality of improved burner nozzles in substantial alignment with a respective plurality of boiler tubes. FIG. 6 illustrates a front elevation view of an example implementation of this combustion chamber 600. The combustion chamber 600 includes a plurality of burner nozzles 200 extending from a secondary air manifold 601. Secondary air manifold 601 includes a plurality of air outlets 602 that are spaced apart in a manner that surrounds burner nozzles 200. Combustion chamber 600 also includes a pilot flame assembly 603 that includes holes that align burner nozzles 200.

During operation, pilot flame assembly 603 emits a plurality of pilot flames that ignites fuel-air mixture flowing through burner nozzles 200. Air directed through air outlets 602 pass over and around burner nozzles 200, forming an "air blanket" around those burner nozzles 200. The air blanket serves to both supply oxygen to pilot flame assembly 603 and burner nozzles 200, and to stabilize and direct flames extending from burner nozzles 200 into their respective boiler tubes.

Figure 7:
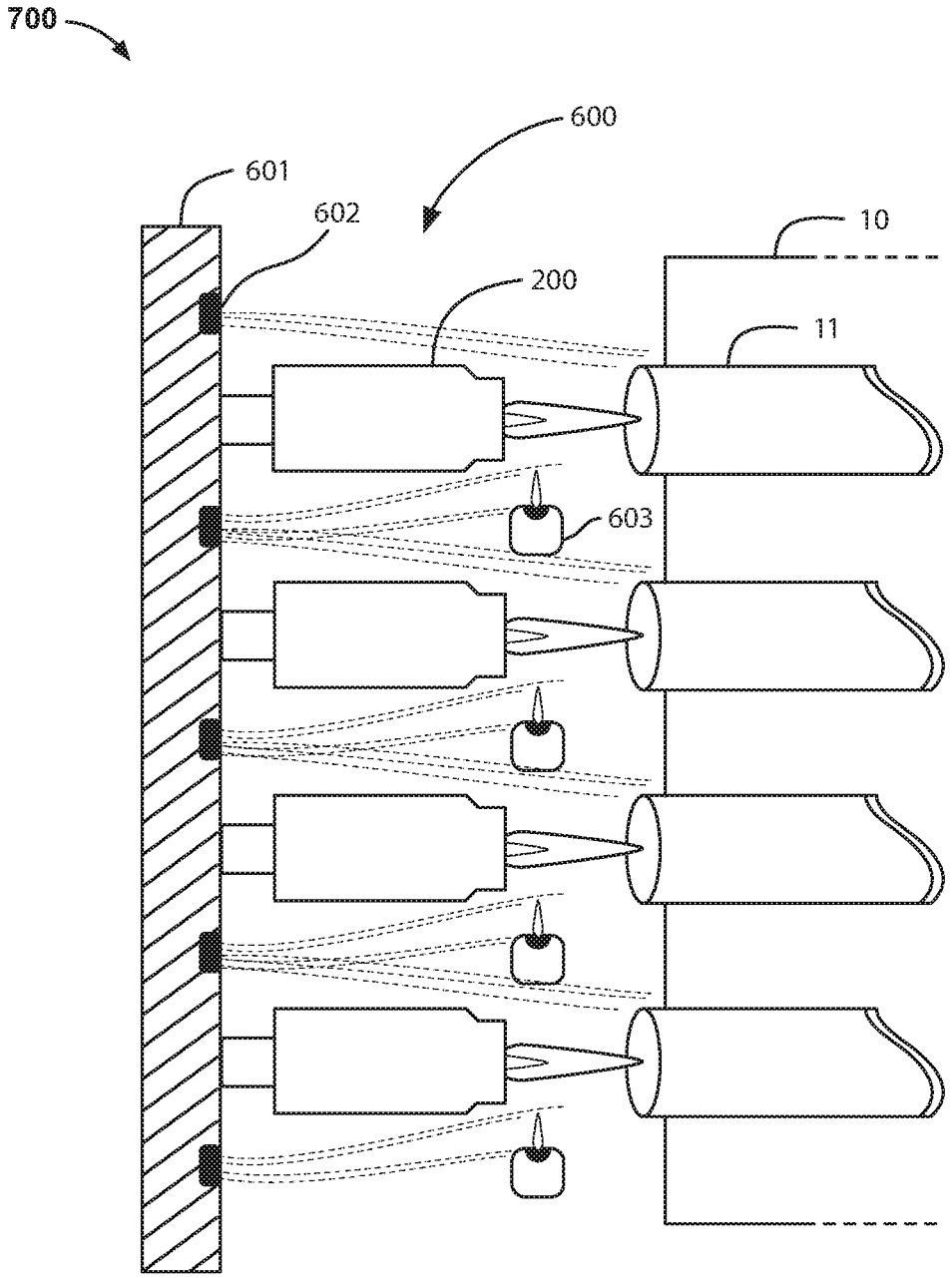
FIG. 7 is a schematic side view of a combustion chamber showing secondary air flow directed around a plurality of burner nozzles, according to an example embodiment.
Figure 8:
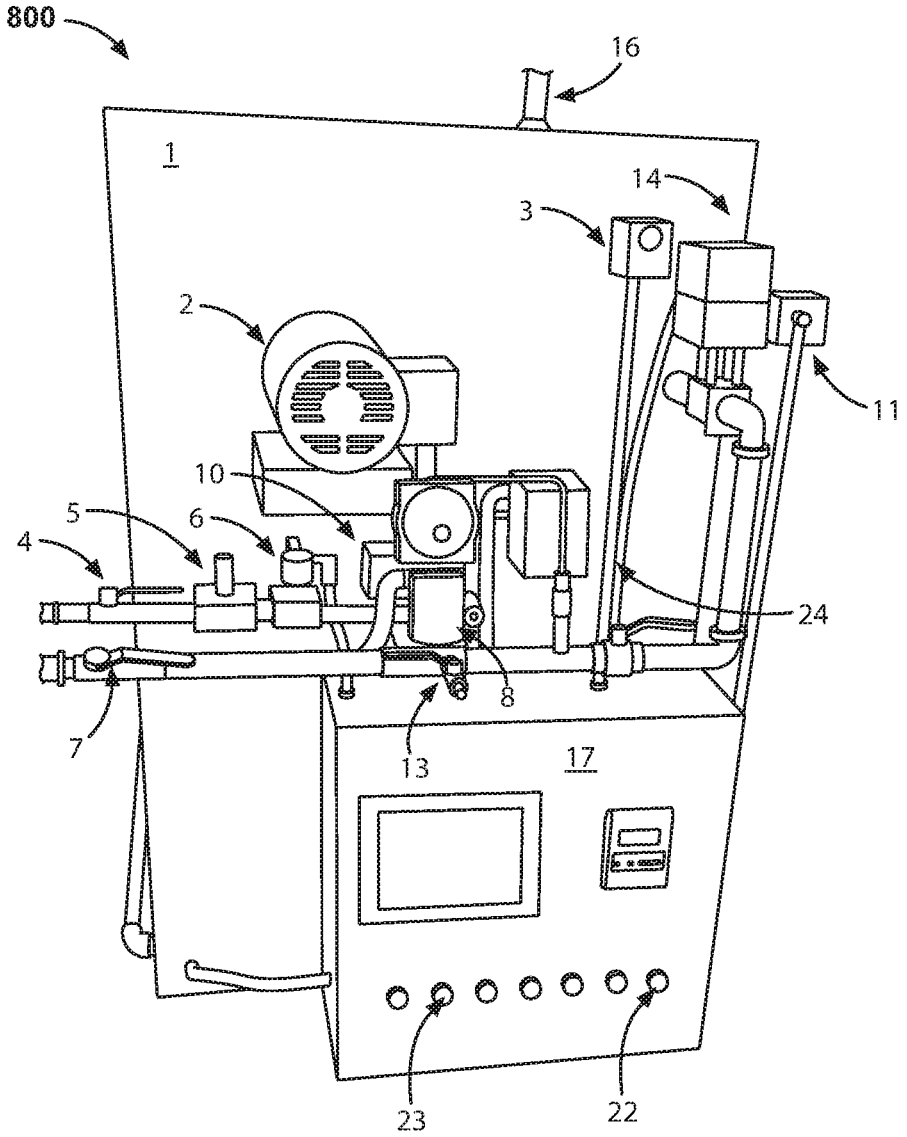
FIG. 8 depicts a front view of a horizontal immersion tube boiler, according to an example embodiment.

Although not explicitly shown in FIGS. 6 and 7, combustion chamber 600 may further incorporate other ignition elements (e.g., electrodes), pilot flame fuel source lines, sensors, and/or other elements. Additionally, it should be understood that horizontal immersion tube boilers of the present application utilize any number of burner nozzles 200, any number of pilot flames from pilot flame assembly 603, and any number of secondary air outlets 602, without departing from the scope of the present application. Furthermore, the illustrations of FIGS. 6 and 7 are shown for explanatory purposes, and may or may not be drawn to scale or proportion.

FIG. 7 is a schematic side view 700 of combustion chamber 600 showing the secondary air flow (also referred to as the "air blanket") directed around a plurality of burner nozzles. Secondary air is shown in light dashed lines around burner nozzles 200. As illustrated in FIG. 7, secondary air flows around burner nozzles 200 and directs flames into boiler tubes 11. This air blanket reduces turbulence and ensures that the flame is directed to its intended location. Additionally, the secondary air supplies oxygen needed to sustain the pilot flames from pilot flame assembly 603.

V. DETAILED DESCRIPTION OF OPERATION

A. General Discussion

The horizontal immersion tube boiler as disclosed is a packaged Firetube boiler with an integral combustion chamber and burner. It is intended for commercial heating and process applications and as a hot water or steam boiler. The boiler can be configured in various sizes, including but not limited to sizes ranging from 50 HP to 800 HP.

The burner is a pre-mix modulating type burner that fires natural gas, LP, digester gas and other combustible gases. The burner can also be configured for low NOx firing generating emission levels of 30 ppm or lower (corrected to 3% O2).

The boiler described herein is provided with a Siemens LMV 5 Parallel positioning control which uses a servo to modulate the air damper, fuel valve and the secondary air valve as required for modulation from the minimum to the maximum firing rates as described herein. Linkage control, ratio relay controls and other combustion control systems may also be provided.

The burner assembly incorporates a ribbon pilot which provides a small pilot under each nozzle. The pilot ribbon runs across and up and down the front of the burner assembly. At pilot ignition, a spark ignites the ribbon pilot at one end and a flame spreads across the burner face to the far end where the flame is proven by a flame rod. On main flame, a flame rod on one of the nozzles is used to prove that the main flame is established. The pilot remains on as long as the burner is on, and cycles off when the burner turns off.

The boiler disclosed herein has several unique differences from a conventional Firetube boiler. The primary difference is that the vessel is a single pass boiler (no separate furnace) and the individual burners are offset from and fire into the 2" tubes in the vessel. This configuration omits the need for a separate furnace or turnaround chamber. There is also no need for refractory or baffles to direct flue gases.

Because there is no furnace that will heat at rates different from the tubes in the other passes, there is no thermal shock. Every tube inside the vessel receives the same heat input and has substantially the same growth so there is no uneven heating and expansion to cause thermal stress. The boiler can thus be operated at high firing rates immediately after startup.

B. Improved Burner Assembly and Nozzle Design

As discussed above, an inherent limitation in prior art horizontal immersion tube boilers was their inability to operate on a modulated basis. The burner either functioned in full on or a full off mode. Modulation, e.g., operating at less than 100% requires that the fuel/air velocity be decreased. However, at lower velocities, the flame burning at the nozzle typically retracts into the nozzle and, in turn, into the gas manifold, likely causing an explosion.

Moreover, effective modulation typically requires a turndown of 5:1, e.g., (the energy input at low fire being no more than ⅕ of the rated energy output). Accordingly, the nozzle design is critical to the operation of the burner, and, in turn, the ability to operate at the desired modulation. The unique design of the nozzle—flame arrestor assembly disclosed herein allows for a single pass horizontal immersion boiler to modulate with the desired (5:1) turndown.

The improved nozzle disclosed provides a means of preventing the flashback (retraction) of the flame which would otherwise cause an explosion in the burner manifold. Normally, the velocity through the nozzle is higher than the flame velocity such that the flame never travels backwards through the nozzle. To achieve modulation, the gas (fuel/air mixture) velocity drops as the input is decreased and thus reaches a point where the flame speed is lower than the gas/air mix velocity, such that the flame will travel back into the manifold and cause an explosion.

To avoid this undesirable condition a unique nozzle disclosed herein incorporates a flame arrester consisting of a metal component having small diameter holes for the gas/air mix to travel through. If the flame were to try to flow backwards through the arrestor and into the body of the nozzle, it will be extinguished by the cooling action of the metal block and thus cannot create an explosion in the manifold.

One specific embodiment of the flame arrestor comprises a metal block ¼" thick having holes no more than ⅛" in diameter. One prior design by the inventors satisfied this general criteria but nevertheless proved able to achieve only limited turndown of approximately 3:1 which did not provide the desired modulation. Moreover, a prior flame arrestor design did not provide acceptable flame stability, CO or unburned gases, excess air, or combustion noise and rumble during combustion.

The design of the improved nozzle/flame arrestor provides a solid compact flame that does not expand too quickly (flair out to a larger diameter). Because the flame must travel approximately 2" before entering the tube it cannot flare out over this distance because that can cause turbulence at the tube entry, which would result in combustion noise or rumble. With modulation, this condition is made much worse when firing at low rates, where velocities are much lower. The inventive designs disclosed herein permit the desired degree of modulation and address the problem of noise and rumble The flame produced by the nozzle/flame arrestor has a diameter small enough to allow it to fire into the boiler tube without producing any turbulence as it passes into the tube, which turbulence would otherwise result in violent and undesirable combustion noise. While a compact flame is desirable in a non-modulating design, it is critical to enabling modulation because the flame will inherently spread more when firing at low rates compared to when firing at high rates. The provision of a nozzle body having longer length relative to its bore hole diameter provides the desired focused flame.

One optimized design incorporates a ⅝" bore hole that fires up to 91000 BTU/hr into the 2" boiler tube, though the nozzle bore diameter and tube diameters can be modified to provide other inputs, and as long as the flame extends and remains well within the tube diameter. It is believed that by keeping the flame arrester holes within the same bore diameter, and enforcing this bore diameter, the nozzle/flame arrestor performs as required to achieve 5:1 modulation.

The design and operation of the improved nozzle/flame arrestor can be described as follows.

The nozzle must have a velocity below where flameout can begin. There is a maximum flame speed for a premix burner (approximately 18 feet/sec) and if the velocity is greater, the flame will be pushed off the end of the nozzle. The exact maximum velocity varies with a number of factors including air temperature and excess air rate. The maximum velocity is also complicated by the difference between the velocity within the nozzle body bore and the velocities through the individual small holes in the flame arrester. The "indicated velocity" is believed to be midway between the velocity calculated from the nozzle bore and the velocity from the sum of the holes in the flame arrestor end (with some averaging at the exit of the flame arrestor). The design places the normal operation at rated capacity close to the maximum velocity so that at low fire there will still be some reasonable velocity to prevent flare-out of the flame. The addition of the flame arrestor significantly complicates this requirement. Normally, a burner would use a nozzle with a 0.567 diameter bore, but with the flame arrester reducing this opening size, the net velocity out of the flame arrester is greater than the flame-out velocity. A nozzle with a larger bore diameter of 0.625" allows enough small hole openings in the flame arrester to keep below the flame-out velocity for the normal maximum firing rate of 91,000 BTU/hr.

The nozzle must provide a stable flame front at all firing rates. Means should be used to retain the flame at the base of the nozzle to provide a stable flame. If this is not provided, the flame will have a tendency to move off the end of the nozzle and become unstable (moving away from the end of the nozzle) and potentially cause a flameout. Providing a separate zone within the nozzle where the pressure and velocity are greatly reduced, and an exit at the outer circumference of the nozzle produces the desired flame stability. This is indicated by a visible blue haze at the end of the nozzle where a small amount of fuel and air are burning, resulting in a circular blue flame around the circumference of the nozzle tip.

The nozzle must project the flame into the center of the tube, with the bulk of the combustion and heat released within the tube. In practice, it is difficult to have every nozzle fire directly in the center of every boiler tube opening which is why the flame diameter must be much smaller than the inside dimension of the boiler tube, and the flow of the secondary air must be controlled, providing clearance for any misalignment of the nozzle to tube.

The premix burner, like surface premix burners, will produce lower NOx emissions with the increase of excess air. Higher excess air will reduce the flame temperature which is source of the (thermal) NOx. Only the primary air (mixed with the gas before going through the nozzle) will reduce NOx emissions. Supplementing the excess air with secondary air has little impact on the NOx emissions. In addition, FGR (flue gas recirculation (FGR)) can be added to the primary air to further reduce the NOx emissions, which also works to reduce the NOx emissions. FGR has the additional advantage of not reducing the efficiency (due to the energy lost out the stack at the higher temperature) and adding velocity to the lower firing rates to improve mixing and combustion.

The above design attributes must be addressed in the context of the actual flow rate(s) desired for the nozzle and tube configuration.

One embodiment of the present invention illustrated in FIGS. 2A-5 depicts the assembly of all of the components that comprise the nozzle assembly. This nozzle assembly is made up of three pieces, an outer nozzle body 210, a nozzle insert 220 (also referred to herein as the nozzle "spool") used to shape the flame and provide a stable flame front and a flame arrester 230, shown comprising a circular plate with small holes. Nozzle body 210 is shown with nozzle insert 220 telescopically received into the central bore. Flame arrester 230 is telescopically received and held in place at the opening of nozzle insert 220. The nozzle assembly is secured to a fuel/air manifold via threads 211 which communicates the air fuel mixture to the nozzle assembly. The mixture passes through the central bore of nozzle insert 220 and out through openings in the flame arrester 230. In addition, some of the air fuel gas mixture passes through openings 225 formed in a shoulder region of insert 222 (such as by drilling) which serves to convey the mixture through passage 224 exiting the nozzle assembly in the space between the outer end of nozzle insert 220 and the inner circle surface of nozzle body 210.

The flame arrester 230 is used to prevent the flame from flowing backwards and causing an explosion in the manifold. It has been determined that a flame arrester having holes ⅛" or smaller and formed from a plate ¼" thick achieves the desired result and it is believed that this design works to cool the flame if it tries to move back through the plate. It is believed that variations in thickness of the plate and diameter of the holes could also work.

There is an upper limit of the velocity of the fuel/air mixture passing through the nozzle such that exceeding that velocity will result in a flameout (wherein the gas/air velocity is greater than the flame speed and thus pushes the flame off the end of the nozzle). Accordingly, the holes in the flame arrester serve to control the flow rate needed to maintain a velocity below the flame speed limit.

However, one of the key issues is the need to maintain a flame that has a small diameter and that will not flare out over the first several inches of travel after leaving the nozzle, which would otherwise result in undesirable turbulence at the tube and secondary air entrance. It was determined that providing a consistent small diameter (⅝") flow tube through the nozzle in combination with a flame arrester plate sized to fit within said diameter worked to minimize turbulence.

Matching the flame arrester to a fixed inner diameter is important given that the resulting velocity must also be below the flame speed to prevent a flame-out. It has been found that orienting the ⅛" holes in the flame arrester plate as close to each other as possible while allowing for the addition of smaller diameter holes therebetween to provide as much flow as possible and forming an overall flow diameter substantially equal to the ⅝" nozzle insert tube opening reduces the pressure drop and provides a wider safety margin to the flame speed. It is believed that if the flame arrester plate does not closely match the ⅝" diameter, the resulting flame would not be sufficiently concentrated and would be more likely to cause combustion noise and rumble.

Another consideration is the need for the nozzle to provide a stable flame front, i.e., a flame that remains anchored at the base of the nozzle. In the present design, flame stability comes from creating a low velocity flow area into which a small amount of gas is diverted to, through holes 225 into a low pressure zone 224 and out notches 226 formed around the periphery of the end of nozzle insert 220. This gas has a relatively low velocity which makes it very stable and can be observed burning at the base of the nozzle, which provides a "pilot" to maintain a stable flame at that location.

C. Secondary Air Supply

Primary air is the air that is mixed with the fuel and passes through the nozzle. Secondary air is that air that does not get pre-mixed with the fuel, but instead is injected into the chamber where the flame is initiated to support the pilot flame and to provide additional air flow into the boiler tubes to promote combustion and to provide a blanket of air at the entry to the boiler tubes. Combustion noise or combustion rumble is often caused by a turbulent area that forms in the combustion zone, where the turbulent flow upsets the normally smooth combustion process. Traditionally, burners are directly attached and sealed to the combustion chamber so that there is no disruption in the flow. A refractory shape is provided to help direct the combustion gases and shield the burner from the heat of the combustion process. With the present design, there is a potential for turbulence to occur as the burning fuel/air mixture enters the tube, and early nozzle designs which resolved the flashback problem experienced problems at the tube entry and caused combustion rumble. The specific causes of the turbulence and rumble can be difficult to diagnose because turbulence can also be caused by nozzles that are off-centered or built incorrectly. It is not known for certain exactly how much secondary air is needed and how volume changes with the shape of the flame and other combustion variables.

It is believed that one key to preventing combustion noise and/or combustion rumbling is the provision of secondary air that creates an air blanket around the tube entrance so that there is less potential turbulence where the flame enters the tube. There appears to be a large variation in the specific need for secondary air based upon how well the flame may be centered in the boiler tube and the combustion characteristics of the flame, but it is observed that either too little or too much secondary air will destroy the flame or cause rumbling.

Secondary air also provides some degree of shield to protect the combustion chamber from the open flame at of the nozzle. Without secondary air, a small leak in the door seal would allow the flame to flow through that seal area, and would quickly burn through the steel. With the combustion chamber "pressurized" by secondary air, any leak will simply result in some air loss, but will not create hot spots or failures and further ensure that the flame is always flowing into the tube and will not be pulled in some other direction that would cause rumbling.

Much of the air for combustion comes from the primary air that is mixed with the fuel gas. Allowing some of the combustion air to come from the secondary air chamber reduces the overall pressure drop and increases the burner capacity. Additional secondary air also limits the NOx reduction capability, as only primary air can effectively reduce the flame temperature and reduce NOx emissions. A standard (non low NOx) burner would typically be set with about 25% or more secondary air to improve rate. A low NOx burner would typically have only 10% secondary air, and often requires a larger fan and motor to achieve rate.

Control of the flow of secondary air in a prior design of an immersion Firetube boiler had been accomplished and adequately managed with a manually adjusted valve position. As an On-Off burner, only one position was needed to match the secondary air flow with the demands of combustion. With modulation, additional control is required to support the different low to high fire needs, and is further complicated by the emission requirements. Specifically, while an "On-Off" burner or a burner with only a 3:1 turndown can use a manually set and fixed valve position, a modulating control is needed to obtain the higher 5:1 turndowns and low NOx operation.

One key to the novel secondary air supply is a new air distribution system. Testing has shown that the air flow to individual boiler tubes was not uniform. It was clear that while existing air distribution systems provided some attempt to spread out the air flow, they were not intended to force a uniform distribution to ensure that each tube will receive the same amount of air. A prior art design incorporated a perforated material over the secondary air holes to provide some spreading of the air. There was no measurable pressure drop in that system, so the distribution was poor. In the present design, a sealed chamber is formed in front of the boiler tubes, and a uniform pattern of small holes (½" diameter) is provided across the boiler tube area.

Figure 9:
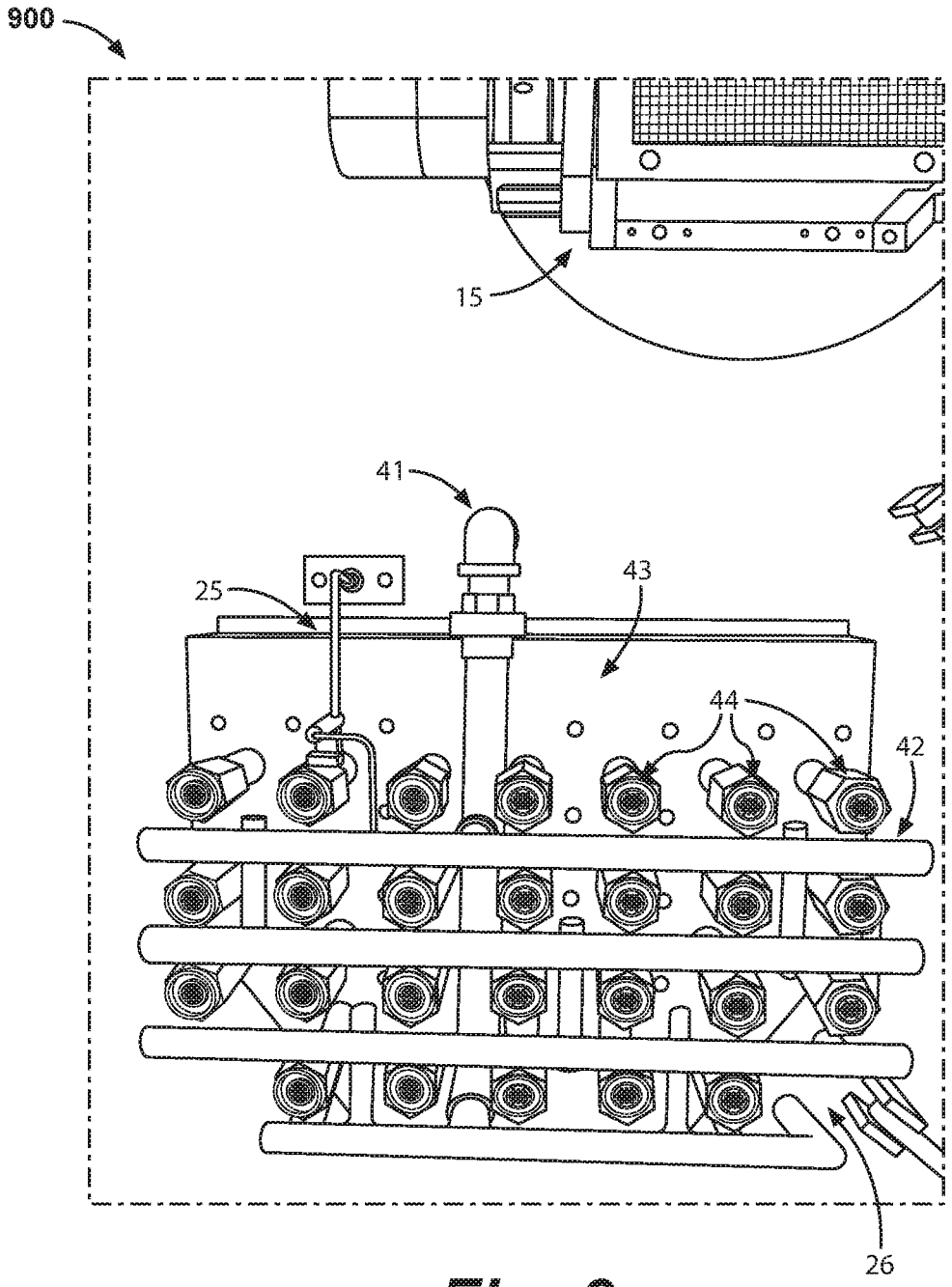
FIG. 9 depicts a front view of the combustion chamber of a horizontal immersion tube boiler, according to an example embodiment.
Figure 10:
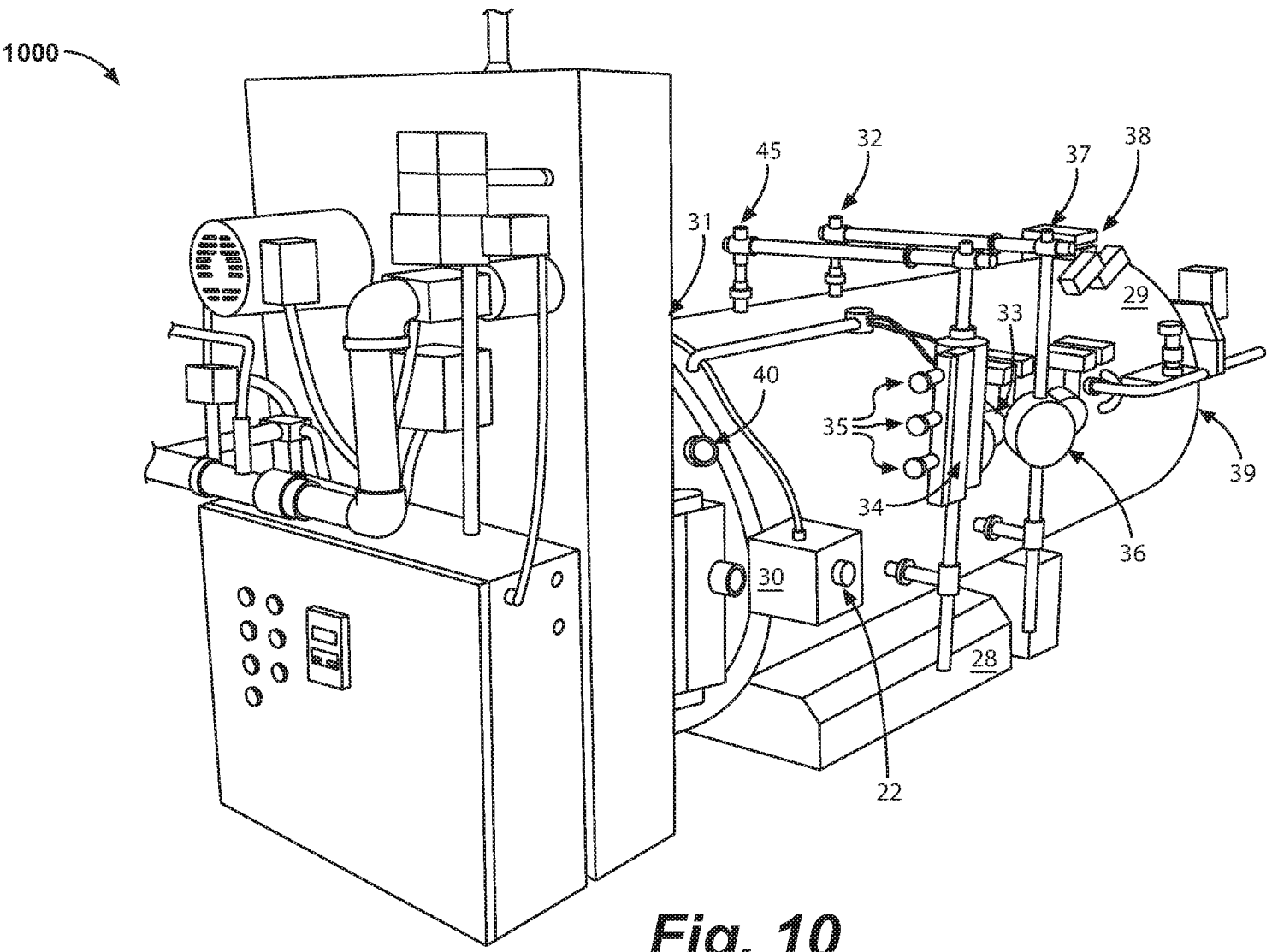
FIG. 10 depicts a perspective side view of a horizontal immersion tube boiler, according to an example embodiment.

FIG. 9 illustrates the novel secondary air supply plate, nozzle/flame arrestors.

D. Combustion Chamber

The combustion chamber that is identified herein is not the same as the chamber referred to as a furnace in a traditional Firetube boiler. In a typical 200 HP Firetube boiler, the furnace would comprise a 24" diameter tube that runs the length of the vessel (except a wetback would have a larger chamber attached at the end). This is normally the area where combustion occurs and is large enough to allow complete combustion to have taken place. In the present design, the combustion chamber is a chamber where combustion starts, at the end of the burner nozzles, but only about 2" of flame are exposed in this combustion chamber, as the flame then enters the tube to complete the combustion and provide heat transfer to the tube wall. This chamber contains the burner nozzles, the secondary air chamber (and secondary air flow), the pilots and the flame proving instruments.

E. Pilot System

The pilot is unique on the present boiler design and is an integral part of the unique burner that can fire into individual tubes which allows operation with a single pass of tubes and eliminates the issue of thermal shock, refractory, baffles and greatly reduces the overall size of the boiler. There are many nozzles that fire into the tubes (100 nozzles and tubes in a mid-sized, 200 HP boiler), and to ignite each nozzle requires a special pilot arrangement. Normally, there is one large flame supported by a single pilot and flame proving arrangement. However the number of individual nozzles and flames cannot be supported by individual pilots and flame safeguards.

A "Runner Pilot" is used to allow multiple nozzles and flames to operate. The runner pilot is a pilot composed of a tube with multiple small holes along the tube length, so that the pilot is actually a long array of small pilot flames that are positioned under the nozzles, and are used to ignite the nozzles. These tubes are run throughout the nozzle array, so that they can ignite each nozzle at the same time. For safety, the pilot is proved by placing a flame rod on the opposite corner from the pilot ignition source, which will prove that all of the pilot runners have started within an allowed time. The nozzle combustion is proved by placing a flame rod on one of the nozzles, which proves that the nozzles are lit and not just the pilot.

F. Fuel/Air Mixing Valve

A valve is used to mix the fuel and air together. The quality of the mixture is critical to the performance of the boiler. Specifically, the potential performance gains of a pre-mix combustion are only available if the fuel and air are thoroughly mixed. If the mixture is not uniform, the combustion performance will be closer to a diffusion burner rather than a pre-mix burner. Testing has shown that improving the quality of the mix results in improvements in stack temperature, efficiency and pressure drop. This happens because when one reduces the flame size (due to higher heat release and velocity) one reduces the radiant heat transfer zone and increases the convective heat transfer zone. The lower average temperatures in the tube result in a lower pressure drop. In the specific testing, the stack temperature dropped about 70° F., and the efficiency increased almost 2%.

In addition to improving the quality of the fuel and air mixture, the addition of modulation changes the operation of the mixing valve. In the prior valve design, the fuel is induced into the air stream, allowing it to operate at a very low pressure. While this may work well at high flow rates where turbulent flow provides good mixing, at low flow rates required for modulation, the turbulence is diminished, and mixing quality is greatly reduced.

A new mixing valve is provided that uses a mechanical means of forcing the fuel and air mixing. It does this by placing the fuel in multiple locations within the air stream, providing a more uniform fuel and air mixture.

G. Modulating Control System

A modulating control system requires that the fuel and air flow be modulated between the minimum (low fire) input to the maximum (rated) input. In addition to changing the flow rates to provide the required 5:1 turndown, the combustion controls must maintain a uniform relationship of fuel and air flow to keep the combustion performance at an optimum level. To provide this, a commercially available control system (LMV5 series from Siemens) is used in combination with an air damper and fuel flow control valve. The Siemens LMV5 control uses servo motors to position the air damper and fuel control valve, to maintain the correct fuel-air-ratio throughout the firing range of the 5:1 turndown.

The LMV5 control system, air damper and fuel control valves are commercially available products. These and similar controls offer a wide variety of options to improve the systems, from advanced display and communication to expanded annunciation and added controls like VFD and Oxygen trim.

VI. SYSTEM COMPONENTS

Following is a list of the main components used in the boiler together with a description of their function. (The numbered paragraphs corresponding to the reference numbers appearing in FIGS. 8-12.)

Burner Assembly [1]—An assembly of the components required to provide the fuel and air for combustion, and the controls to provide safe light-off and control of the combustion process. Some of the vessel controls are also included in the burner controls.

Blower Motor [2]—Drives blower fan to provide the air required for combustion. A motor operating at 3500 RPM is suitable. An open drip-proof (ODP) style motor may be used, but other versions are acceptable. A totally enclosed fan cooled (TEFC) motor would typically be used for dirty or outside environments.

Air Proving Switch [3]—This is a safety interlock switch that measures the pressure developed by the combustion air fan, and opens if that pressure drops below its setting. It prevents the ignition sequence or shuts off the burner under conditions of insufficient combustion air pressure. (automatic reset device)

Pilot Shutoff Cock [4]—A ball valve that is used to manually control the pilot gas volume or isolate the pilot gas flow. The actual adjustment of the pilot gas flow is done by adjusting the pilot gas pressure regulator Pilot Gas Pressure Regulator [5]—A manually adjusted pressure regulating valve that provides a constant gas pressure to the pilot. It is the primary means of controlling the pilot gas flow.

Automatic Pilot Gas Valve [6]—Solenoid valve(s) that automatically control pilot gas supply in response to burner operation through the flame safeguard sequence. The pilot remains on through the main flame operation in addition to the pilot proving period.

Main Gas Shutoff Cock [7]—A manual valve used to isolate the main gas supply to the burner assembly. (Installed upstream of main gas train components).

Main Gas Pressure Regulating Valve [8]—A manually adjusted pressure reducing valve that provides a constant gas pressure to the main burner. In some cases, this is built into the Safety Shutoff Valve; otherwise it would be located in front of the Safety Shutoff Valve(s).

Safety Shutoff Valve(s) (not shown)—Electric valve(s) (can be motor and/or solenoid) that control gas supply to the main burner in response to the operating sequence of the controls, including the flame safeguard. They can also be integrated into the gas pressure regulator as shown as 8.

Low Gas Pressure Switch (if provided) [10]—A gas pressure switch that prevents the operation of burner in the event of unsafe low gas supply pressure. This is a manual reset device which requires that the reset button be pressed to allow the switch to re-start and allow the burner to operate.

High Gas Pressure Switch (if provided) [11]—A gas pressure switch that prevents the operation of burner in the event of unsafe high gas supply pressure. This is a manual reset device which requires that the reset button be pressed to allow the switch to re-start and allow the burner to operate.

Normally Open Vent Valve (if provided) (not shown)—Provides unrestricted vent to atmosphere between dual main automatic safety gas valves when burner is off (not pictured) This is not normally used with propane (or LP) because it is heavier than air and will tend to pool at a low point which could explode.

Leakage Gas Shutoff Cock [13]—Manually controls main gas supply to the burner assembly. This valve is also sometimes called the safety valve because it is used to manually control gas flow on initial startup, and quickly shut off gas flow if combustion is not correct. It also allows for manual leak testing of automatic safety gas valves and is installed downstream of last automatic safety gas valve.

Gas Control Valve and Servo [14]—A combination of a butterfly control valve and a servo motor that modulates the valve to control the volume of gas to the main burner. This valve is controlled in combination with the air damper to provide the correct fuel-air-ratio to the burner nozzle. The butterfly control valve is sized for each specific application, based on the flow rate and available pressure.

Combustion Air Damper and Servo [15]—A combination of a modulating air control box that changes the volume of total air supplied to the burner and a servo motor that positions the damper. The servo is controlled in combination with the fuel valve to provide the correct fuel-air-ratio to the burner nozzle.

Secondary Air Adjustment(s) [16]—A manual adjustment (and lock) for controlling the secondary air. (On smaller boilers, a single adjustment may be mounted on top of the burner assembly. This will change how much air is used in the primary air and how much in the secondary air flow.

Control Panel [17]—Houses and protects electrical controls and wiring and provides terminals for wiring connections.

Manufacturers Nameplate (not shown)—Provides identification and rating information specific to the boiler.

Flame Safeguard and Combustion Control [19]—The Flame safeguard provides and controls safe sequence of the burner and inter-related operating and safety controls. The combustion control provides the physical control of the fuel and air flow rates from low fire to high fire and through modulation. The unit shown contains both controls in a single package, but other products can have individual controls.

Control Circuit Transformer [20]—Converts primary electric supply voltage to 120-60-1 phase for the boiler control circuit.

Blower Motor Starter [21]—A relay that provides on-off control of the blower motor in response to flame safeguard sequence.

On-Off Control Switch [22]—Provides manual on-off control of the boiler (sometimes called safe start switch).

Indicating Lights [23]—Provides visual signal to verify current operating status of boiler.

Ignition Transformer [24]—Provides high voltage electric output to ignition electrode for safe ignition.

Ignition Electrode [25]—Provides spark for safe pilot ignition.

Pilot Flame Proving Electrode [26]—Senses presence and proper location of the pilot flame for safe main burner ignition. The proving rod is opposite the ignition electrode, so that the pilot must ignite across the full burner face to prove all of the pilots have ignited.

Main Flame Proving Electrode—Senses presence of main burner flame in proper position for safe main burner operation. (Typically not furnished on boilers less than 60 HP.) (Not pictured—same as 26 but located on main burner nozzle)

Structural Steel Base [28]—Supports entire boiler for handling and rigging, and evenly distributes boiler weight.

Lifting Eyes [29]—Connection points for lifting the boiler.

Electrical Supply Junction Box [30]—Provides primary electrical supply connection to the boiler.

High Limit Pressure Control [31]—A manual reset pressure switch that monitors the steam pressure and will shut down the boiler if high limit pressure is exceeded. Once tripped, it must be manually reset.

Pressure Gauge [32]—Provides visual verification of boiler operating pressure.

Pump Control/Primary Low Water Cutoff (LWCO) [33]—Provides on/off pump operating contacts for proper level control in the boiler and prevents operation of the burner assembly in the event of unsafe water level condition. (automatic reset device) The control uses a float to activate switches for the pump control and low water cutoff.

Water Gauge Set [34]—Provides visual indication of the water level in the water column and the boiler shell.

Try Cocks [35] (Optional)—Provides method for manually verifying the water level indicated by the water gauge set. Opening the try cocks will determine if water or steam is present at that level.

Auxiliary Low Water Cutoff [36]—(ALWCO) Prevents operation of burner assembly in the event of unsafe water level condition. (manual reset device). The ALCWO can be a float controlled switch (as shown) or an electronic control mounted in the center of the vessel.

Relief Valve(s) [37]—Relieves internal pressure in boiler in the event component failures allow unsafe pressure condition to develop.

Stack Outlet [38]—A stack connection is provided at the rear of the boiler for connection to the stack or breeching.

Combustion Sight Glass [40]—Provides for visual inspection of pilot and main burner condition. There are several sight glasses to visually inspect the pilot and main flame combustion.

Pilot Gas Header [41]—Delivers pilot gas to the runner pilots.

Runner Pilots [42]—Provides ribbon flame below all main burner nozzles for ignition. This pilot remains on during the burner firing.

Secondary Air Box [43]—A pressurized box that has numerous small holes for uniform distribution of secondary air to the pilots and main flames.

Main Burner Nozzles [44]—Flame retention type nozzles deliver pre-mixed air and gas across runner pilots and into the fire tubes for combustion.

Pressure Transducer [45]—Provides a signal to control the burner On-Off cycling and modulating firing rate in response to load changes.

Figure 11:
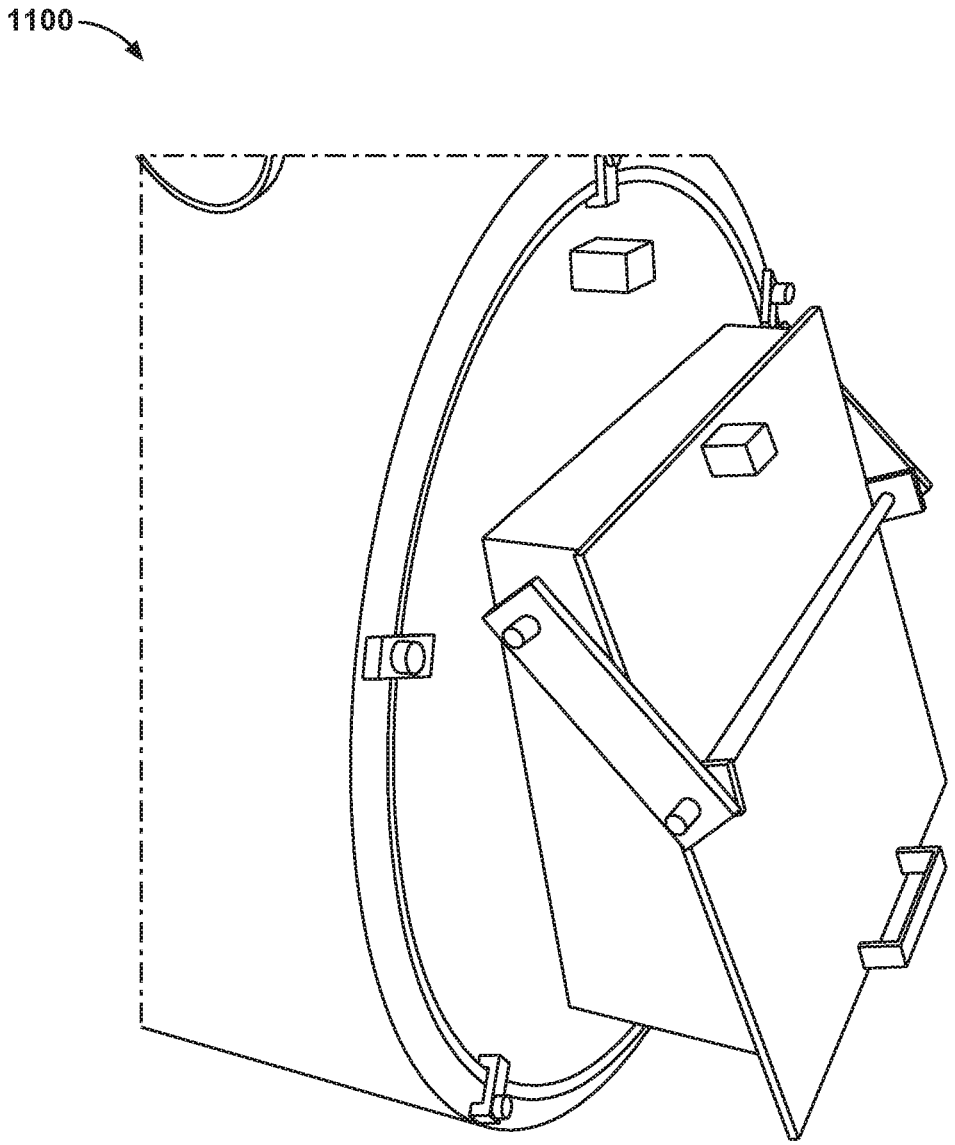
FIG. 11 depicts a perspective side view of a relief door for a horizontal immersion tube boiler, according to an example embodiment.

Relief Door [FIG. 11]—A combustion relief door is provided at the rear of the unit that provides a relief opening in the event of a combustion explosion. The door has a gasket seal that provides a seal and prevents air from entering which would otherwise result in a false high excess oxygen reading.

Advantages and benefits provided by the improved horizontal immersion tube boiler design disclosed herein include.

The present design uses only pre-mixed fuel and air for combustion (natural gas, propane, digester gas or similar gas fuels). A pre-mixed combustion flame has different combustion characteristics from a diffusion flame, the most important being the ability to have a much smaller space requirement for combustion (approximately one tenth the size). This allows the combustion to occur in the tube, the same tube that provides the convective heat transfer, and eliminates the need for a large furnace to contain the slow burning process of a diffusion flame.

The present design eliminates thermal shock and allows the vessel to warm up quickly and start generating steam, typically in less than 20 minutes. Thermal shock is eliminated, in part, because each tube receives the same heat input and will expand the same amount. Accordingly there are no furnace elements or tubes that will expand or contract at different rates that would otherwise cause the tubes to pull out.

The present design provides for a pre-mix flame that has a much higher flame speed than that provided by a diffusion burner—approximately 10 times higher than a diffusion burner. This allows the flame to be fired into the tube with spacing between the nozzle tip and the tube thereby eliminating the need for burner throat refractory. This space further permits a running pilot to be placed in front of the nozzles and used to ignite the nozzle flames.

The present design eliminates the turnaround requirement and, in turn, eliminates the need for refractory and the maintenance and seals a traditional Firetube boiler otherwise requires. The design also allows easy access to all tubes and tubesheets without the need for special lock-out safety requirements.

Instead of burning large amounts of fuel in a large furnace, the present design provides for combustion divided into small regions of individual tubes greatly reducing the explosive force generated in a large furnace and related safety issue.

In a traditional Firetube boiler with a diffusion burner, the furnace used for combustion space represents a significant portion of the cost, yet provides only a small amount of the heat transfer surface. In the immersion boiler of the present design, the combustion space and convection space are the same allowing for an optimized heat transfer at all firing rates.

VII. CONCLUSION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

It should be understood that arrangements described herein are for purposes of example only. As such, those skilled in the art will appreciate that other arrangements and other elements (e.g. machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. It is also to be understood that the terminology used herein is for the purpose of describing particular implementations only, and is not intended to be limiting.

The invention claimed is:

1. A burner nozzle for a horizontal immersion tube boiler, the burner nozzle being operable to supply a flame into a boiler tube, the burner nozzle comprising:

a substantially cylindrical outer housing having inner walls and outer walls;

a spool positioned within the housing and having a first region, a second region, and a transition region disposed between the first region and the second region, the spool having a central bore extending therethrough, wherein the first region has a first inner diameter and a first outer diameter, wherein the second region has a second inner diameter and a second outer diameter, wherein the second inner diameter is less than the first inner diameter, wherein the second outer diameter is less than the first outer diameter, wherein a diameter of the transition region is tapered from the first region to the second region to form a sloped annular wall;

an inlet chamber defined by a portion of the central bore extending through the first region of the spool, the inlet chamber being operable to receive fuel-air mixture;

a primary flow passage defined by a portion of the central bore extending through the second region of the spool, the primary flow passage being in coaxial alignment with the inlet chamber, and the primary flow passage being operable to receive a first portion of the fuel-air mixture from the inlet chamber;

a secondary flow passage at least partially defined by an annular chamber formed between an outer surface of the second region of the spool and the inner walls of the housing, the secondary flow passage being operable to receive a second portion of the fuel-air mixture from the inlet chamber;

a plurality of inlet openings circumferentially spaced along the sloped annular wall, the plurality of inlet openings being configured to direct the second portion of the fuel-air mixture from the inlet chamber to the secondary flow passage;

a plurality of outlet openings configured to direct the second portion of the fuel-air mixture from the secondary flow passage toward the boiler tube; and a flame arrestor disposed proximate to the primary flow passage and configured to direct the first portion of the fuel-air mixture from the primary flow passage toward the boiler tube through a plurality of passages formed therein.

2. The burner nozzle according to claim 1, wherein fuel-air mixture directed through the flame arrestor flows at a first velocity, wherein fuel-air mixture directed through the outlet openings flows at a second velocity, and wherein the second velocity is less than the first velocity.

3. The burner nozzle according to claim 1, wherein fuel-air mixture flowing through the outlet openings serves to reduce turbulence and stabilize a flame extending from the burner nozzle.

4. A burner nozzle for a horizontal immersion tube boiler, the burner nozzle being operable to supply a flame into a boiler tube, the burner nozzle comprising:

a substantially cylindrical outer housing having inner walls and outer walls;

a spool positioned within the housing and having a first region, a second region, and a third region disposed adjacent to the second region, the spool having a central bore extending therethrough, wherein the first region has a first inner diameter and a first outer diameter, wherein the second region has a second inner diameter and a second outer diameter, wherein the second inner diameter is less than the first inner diameter, wherein the second outer diameter is less than the first outer diameter, wherein the third region has the second inner diameter and the first outer diameter, and wherein the third region has inner walls proximate to the second region and outer walls facing the boiler tube;

an inlet chamber defined by a portion of the central bore extending through the first region of the spool, the inlet chamber being operable to receive fuel-air mixture;

a primary flow passage defined by a portion of the central bore extending through the second region of the spool, the primary flow passage being in coaxial alignment with the inlet chamber, and the primary flow passage being operable to receive a first portion of the fuel-air mixture from the inlet chamber;

a secondary flow passage at least partially defined by an annular chamber formed between an outer surface of the second region of the spool and the inner walls of the housing, the secondary flow passage being operable to receive a second portion of the fuel-air mixture from the inlet chamber;

a plurality of outlet openings configured to direct the second portion of the fuel-air mixture from the secondary flow passage toward the boiler tube; and a flame arrestor disposed proximate to the primary flow passage and configured to direct the first portion of the fuel-air mixture from the primary flow passage toward the boiler tube through a plurality of passages formed therein.

5. A horizontal immersion tube boiler incorporating an improved burner and air supply assembly, the horizontal immersion tube boiler comprising:

a boiler vessel having a first side and a second side with a plurality of boiler tubes extending from a first side to a second side thereof;

a combustion chamber disposed adjacent the first side of the boiler vessel and an exhaust stack disposed the second side of the boiler vessel, the boiler tubes connecting the combustion chamber section and exhaust stack;

a burner assembly disposed within the combustion chamber, the burner assembly including a plurality of burner nozzles corresponding to the plurality of boiler tubes, each burner nozzle positioned adjacent to and not extending into its respective boiler tube, each burner nozzle including an inlet chamber operable to receive fuel-air mixture, a primary flow passage in coaxial alignment with the inlet chamber that is operable to receive a first portion of the fuel-air mixture from the inlet chamber, a secondary flow passage that at least partially surrounds the primary flow passage and is operable to receive a second portion of the fuel-air mixture from the inlet chamber, a plurality of outlet openings configured to direct the second portion of the fuel-air mixture from the secondary flow passage toward the boiler tube, and a flame arrestor disposed proximate to the primary flow passage and configured to direct the first portion of the fuel-air mixture from the primary flow passage toward the respective boiler tube through a plurality of passages formed therein;

a pilot flame assembly operable to produce a plurality of pilot flames corresponding to the plurality of burner nozzles, the pilot flames serving to ignite fuel-air mixture flowing through the corresponding burner nozzles into the respective boiler tubes; and a secondary air supply at least partially disposed within the combustion chamber, the secondary air supply including a plurality of orifices positioned at locations between the plurality of burner nozzles to direct air around the burner nozzles and guide flames extending from the burner nozzles into the respective boiler tubes, the secondary air supply at least partially serving to provide air to the pilot flame assembly for sustaining the plurality of pilot flames.

6. The horizontal immersion tube boiler according to claim 5, wherein the pilot flame assembly comprises:

a pilot gas header fluidly connected to a pilot gas supply; and one or more pilot tubes positioned adjacent to the plurality of burner nozzles, the one or more pilot tubes configured to direct pilot gas from the pilot gas header to a plurality of apertures thereon, the plurality of apertures each operable to support a pilot flame for igniting fuel-air mixture emitted from the respective burner nozzle.

7. The horizontal immersion tube boiler according to claim 5, wherein each burner nozzle has a first end and a second end, the flame arrestors being disposed proximate to the second end, and wherein each burner nozzle further comprises:

a first duct extending from the first end toward the second end and having a third diameter;

a second duct extending from the second end toward the first end and having a fourth diameter that is less than the third diameter; and one or more chambers surrounding the second duct each having an inlet opening proximate to the first duct and an outlet opening proximate to second end, the outlet openings of the one or more chambers being circumferentially spaced around the flame arrestor of the burner nozzle, wherein fuel-air mixture flowing through the outlet openings serves to reduce turbulence and stabilize a flame extending from the burner nozzle.

8. The horizontal immersion tube boiler according to claim 7, wherein the outlet openings of the one or more chambers are radially-extending notches.

9. The horizontal immersion tube boiler according to claim 5, wherein the secondary air supply comprises:

a secondary air manifold disposed within the combustion chamber proximate to the first side of the boiler vessel, the secondary air manifold being positioned nearer the first side than the burner nozzles, wherein the plurality of orifices are arranged to direct air around the burner nozzles toward the second side and serving to provide substantially uniform air distribution within the combustion chamber.

* * * * *